US011167831B2

(12) United States Patent
Mahar

(10) Patent No.: US 11,167,831 B2
(45) Date of Patent: Nov. 9, 2021

(54) SYSTEM AND METHOD FOR A MOTORIZED STAND UP PADDLE BOARD

(71) Applicant: Daniel Arthur Mahar, Anacortes, WA (US)

(72) Inventor: Daniel Arthur Mahar, Anacortes, WA (US)

( * ) Notice: Subject to any disclaimer, the term of this patent is extended or adjusted under 35 U.S.C. 154(b) by 78 days.

(21) Appl. No.: 16/858,144

(22) Filed: Apr. 24, 2020

(65) Prior Publication Data

US 2020/0247517 A1 Aug. 6, 2020

Related U.S. Application Data

(63) Continuation of application No. 14/722,157, filed on May 27, 2015, now abandoned.

(51) Int. Cl.

| | |
|---|---|
| ***B63H 21/17*** | (2006.01) |
| ***B63B 32/10*** | (2020.01) |
| ***B63B 32/50*** | (2020.01) |

(52) U.S. Cl.

CPC ..... *B63H 21/17* (2013.01); *B63B 32/10* (2020.02); *B63B 32/50* (2020.02)

(58) Field of Classification Search

CPC . B63B 35/79; B63B 35/7906; B63B 2035/79; B63B 35/7943; B63B 2755/00; B63B 32/10; B63B 32/50; B63H 21/17

USPC ..... 440/6; 441/74

See application file for complete search history.

(56) References Cited

U.S. PATENT DOCUMENTS

| | | | | |
|---|---|---|---|---|
| 5,017,166 | A | 5/1991 | Chang | |
| 6,142,840 | A | 11/2000 | Efthymiou | |
| 6,409,560 | B1 | 6/2002 | Austin | |
| 6,702,634 | B2 | 3/2004 | Jung | |
| 7,207,282 | B1 | 4/2007 | Ruan et al. | |
| 7,226,329 | B2 | 6/2007 | Railey | |
| 9,718,528 | B2 * | 8/2017 | Railey | B63H 11/00 |
| 9,868,499 | B2 * | 1/2018 | Mier | B63H 11/08 |
| 2003/0167991 | A1 | 9/2003 | Namanny | |
| 2008/0045096 | A1 | 2/2008 | Railey | |
| 2008/0168937 | A1 | 7/2008 | Ruan et al. | |
| 2011/0201238 | A1 | 8/2011 | Rott et al. | |

* cited by examiner

*Primary Examiner* — Daniel V Venne

(74) *Attorney, Agent, or Firm* — Christopher Mayle; Bold IP PLLC

(57) ABSTRACT

A system and method for a stand up paddle board that utilizes a vertical hollow protrusion through the paddle board that supports the propulsion system and is comprised of two assemblies; a motor and propeller assembly, and a battery and control assembly, the location of the hollow protrusion mitigating the negative aspects of propelling the board with a propeller and the extra weight of the motorized system on the board's balance and maneuverability characteristics.

20 Claims, 2 Drawing Sheets

SYSTEM AND METHOD FOR A MOTORIZED STAND UP PADDLE BOARD

CROSS REFERENCE TO RELATED APPLICATIONS

This application is a continuation which claims priority to U.S. Non Provisional application Ser. No. 14/722,157 filed on May 27, 2015 which is incorporated by reference in its entirety.

BACKGROUND

Stand-up paddle boards has changed significantly over the years. The first paddle boards were made entirely of wood. Today's models are fashioned from several different materials. Carbon fiber paddle boards are incredibly sturdy, yet lightweight. Electric paddle board models have motors which propel you through the water have been more popular than ever but the extra weight of equipment associated with a motorized system on a stand-up paddle board or other watercraft can negatively affect a board's handling and maneuverability characteristics. This occurs because a board sits lower in the water incurring more drag. Currently this cannot be mitigated except by minimizing the weight of the motorized system.

The extra weight of the system also increases swing weight, where swing weight in this application refers to any weight that is distal to the rider's operating position on the board without the motorized system installed. Any additional weight that is added by the motorized system (i.e., swing weight) forces the rider to relocate their balance point on the board, compromising performance because the rider is no longer at the board's intended design location for its operator. If there is excessive swing weight in the aft section of the board, the rider may be required to move forward on the board to a position where the rider experiences difficulty using the paddle as a rudder to steer the board. This is a particular challenge for motorized configurations where the motor and propeller assembly are located at, or in close proximity to the fin at the far aft section of the board.

Another negative aspect of swing weight occurs when the rider turns or maneuvers the board by changing its direction. Excessive swing weight during maneuvers slows the responsiveness of the board when conducting maneuvers making the board feel sluggish and more difficult to control. This sluggish characteristic increases in effect as the swing weight is more distal to the rider. When a maneuver is initiated, the momentum of the board's mass is redirected. This redirected momentum requires work in the form of energy expended by the rider. If the rider turns the board with a paddle, the effort to make the turn increases in direct relation to the excess weight on the board and its relative distance from the rider, i.e., swing weight.

Thus exists a need for an invention that mitigates the negative effects of swing weight by reducing, to the greatest extent possible, the distance between the rider and the equipment associated with the motorized system. This allows the rider to remain in the optimal position on the board as intended by the board's designer. It also keeps the board responsive and lively during turns and other maneuvers. A motorized stand up paddle board configured with minimal swing weight assures that the fundamental performance characteristics of the board are preserved. Once preserved, a motorized propulsion system may serve to enhance these performance characteristics without significantly compromising balance and maneuverability.

SUMMARY

This invention provides a method for configuring a battery powered propulsion system for a stand up paddle board or similar stand up personal watercraft that involve standing on the craft during normal use. Critical performance factors for a personal watercraft of this type include being lightweight, balanced and hydrodynamic in shape. Installing a battery powered propulsion system on a stand up paddle board can have significant negative effects on these critical performance characteristics that consequently effect the rider's balance and control. Past configurations have not adequately addressed these negative effects resulting in major challenges to bringing a battery powered, motorized stand up paddle board system to commercial market.

This invention provides a method to configure a battery powered, motorized stand up paddle board systems that mitigates, to the greatest extent possible, the negative effects of adding the system to the watercraft. This invention specifically addresses balance and control issues by providing a convenient method for locating the propulsion system at the center of the watercraft and slightly forward of the rider.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
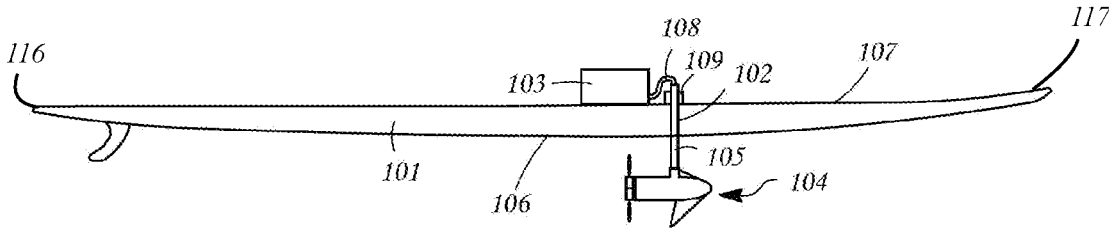
FIG. 1 is a side partial cross-sectional view showing the shaft of the motor and propeller assembly attached to the stand up paddle board and passing through the vertical hollow protrusion.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises", and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps may be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure is directed to a system and method for installing motorized equipment on a balance-sensitive personal watercraft on a stand up paddle board, or similar watercraft in a mid-forward position on the board using a vertical hollow protrusion ("hollow protrusion") to provide a more practical, convenient and commercially viable experience. The key advantages of this configuration are a result of the hollow protrusion through the board supporting the installation of the battery/control assembly and the motor/propeller assembly in a location on the board that is in close proximity to, and in front of the rider. The present disclosure effectively mitigates problems with past inventions that compromise board performance by positioning the battery powered, propeller driven propulsion system on the aft section of the board.

Figure 2:
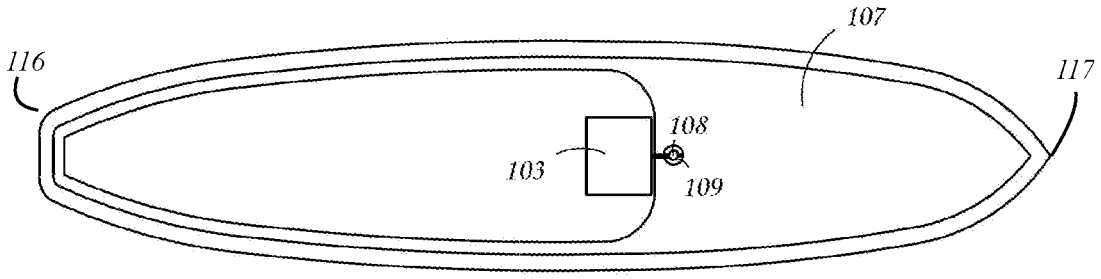
FIG. 2 is a top view showing the stand up paddle board with the battery housing and motor and propeller assembly attached.
Figure 3:
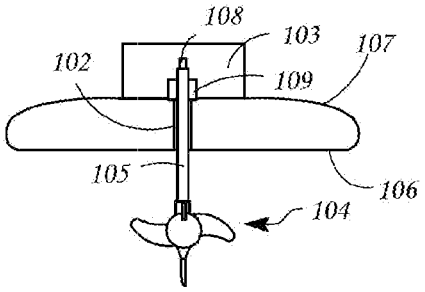
FIG. 3 is a front partial cross-sectional view showing the shaft of the motor and propeller assembly attached to the stand up paddle board and passing through the vertical hollow protrusion.
Figure 4:
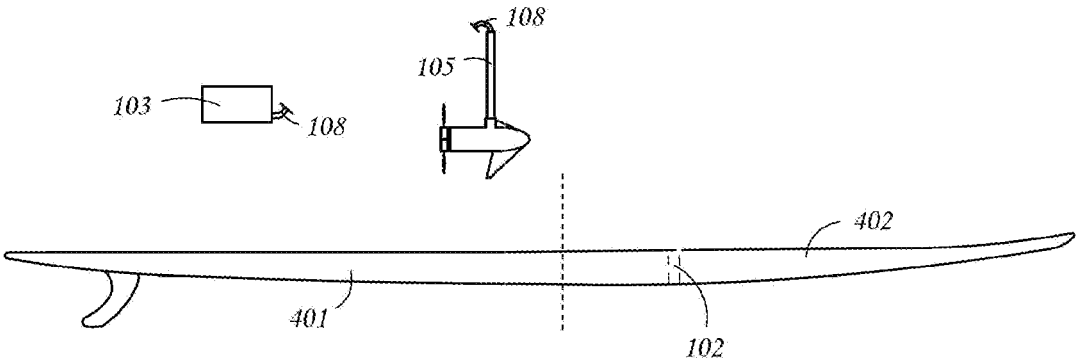
FIG. 4 is an isometric view of the present invention showing the vertical hollow protrusion and both the motor and propeller assembly and battery housing unattached.

With reference now to FIG. 1-3, FIG. 1 illustrates a stand up paddle board 101 with a vertical protrusion 102, as viewed from the side as a cross section through paddle board's 101 centerline, paddle board 101 having a top surface 107 and bottom surface 106 as well as a front end 117 and rear end 116.

In this configuration hollow protrusion 102 supports the installation of a battery powered, motorized propulsion system comprised of two assemblies; an underwater motor and propeller assembly 103, and a battery and control assembly 104. The location of hollow protrusion 102 on paddle board 101 is a critical characteristic of this invention because the location serves to effectively mitigate, to the greatest extent possible, the negative aspects of adding extra weight to paddle board 101 and propelling paddle board 101 with underwater motor and propeller assembly 103.

Motor and propeller assembly 103 may be installed below paddle board 101 in a position that is slightly forward of the rider's normal position on paddle board 101. Motor and propeller assembly 103 may include a motor support shaft 105 installed by placing the support shaft 105 vertically through vertical hollow protrusion 102 in paddle board 101 with the top of support shaft 105 terminating at or above top surface 107 of paddle board 101.

Positioning the motor and propeller assembly 103 in the mid-forward section of paddle board 101 allows paddle board 101 to be easily rotated or turned around that position. This is an important performance characteristic for turning paddle board 101 using a paddle as a rudder while paddle board 101 being propelled through the water, and when making tight turns where there is minimal clearance to obstacles such as in a narrow waterway. This position also mitigates the risk of the rider striking the propeller in the event that the rider falls off paddle board 101 while it is moving. This is different than most propeller-driven watercraft where the propeller is located on the aft section of the craft whereby a fallen rider is more likely to be struck by the propeller because of the forward momentum of paddle board as it is propelled through the water.

The positioning also increases the overall stability of paddle board 101. This is similar to how a keel stabilizes a sailboat. Longitudinal stability (port and starboard) is enhanced because the weight of the motor counterbalances the rider's weight during paddle board 101 handling and maneuvers. To a lesser extent there is also a counterbalancing effect on the paddle board's 101 lateral stability.

The interior of support shaft 105 may be hollow and is designed to contain electrical connection wires 108 from motor and propeller assembly 103 that allow the user to connect motor and propeller assembly 103 to a battery and control assembly 104 located on top surface 107 of paddle board 101.

Battery and control assembly 104 is comprised of a battery and electrical control circuit contained in a waterproof case. A typical waterproof case will occupy about nine inches (9") of space between the rider and the hollow protrusion. The mechanism securing the motor shaft will occupy another two inches (2"). The remaining eight inches (8") is required for the rider to have ample space to move forward while maneuvering paddle board 101 without touching battery and control assembly 104.

Battery and control assembly 104 in close proximity and forward of the rider when in the optimal position facilitating access to equipment associated with the propulsion system. Access to this equipment provides the rider with a convenient means to monitor the system including checking the battery charge level, and ensuring that the electrical and mechanical connections are secure. In addition, this location provides the rider with convenient access to control of the propulsion system including; turning the system on and off, activating the emergency kill switch, and retracting the motor by lifting support shaft 105 during beach landing or during times when the battery no longer has an adequate charge.

Another benefit of the positioning of battery and control assembly 104 is that it allows the rider full access to the mid and aft section 401 of paddle board's 101 top surface 107. Unobstructed accesses to this portion of top surface 107 is important for balancing on and maneuvering the board. Turns on a typical motorized stand up paddle board are performed by the rider moving their weight toward the back of the board and exerting pressure with the paddle in the water on either the port or starboard side of the board. Any obstructions on the aft part of top surface 107 of paddle board 101 hinders the rider's ability to effectively control paddle board 101 and poses a tripping hazard to the rider. A motorized stand up paddle board configuration that maintains a clear, unobstructed working deck for the rider is an important advantage of this invention.

A securing device 109 may be configured to secure the motor and propeller assembly 103 in a fixed position to propel paddle board 101 forward. This fixed position is the preferred option for intermediate and advanced stand up paddle boarders because steering is performed by balancing and using the paddle as a rudder. Support shaft 105 may be secured in a manner that allows the motor and propeller assembly 103 to rotate on a vertical axis, allowing the board 101 to be steered by changing the direction of propulsion.

The hollow protrusion 102 through paddle board 101 is a simple and relatively easy modification to a typical stand up paddle board 101 design that does not add weight to the board 101 and does not impact the performance of paddle board 101 when used without the motorized system. This allows board manufacturers to include this feature on their boards with little additional cost and with no adverse aesthetic, performance, or structural integrity effects to their product. Stand up paddle boards 101 are commonly made using sandwich composite construction and a small, vertical hollow protrusion 102 constructed properly through the board's centerline stringer will not undermine the structural integrity of the board.

The hollow protrusion 102 through paddle board 101 may be used for accessories other than a motorized propulsion system. These include, but are not limited to; fittings for windsurfing comprised of a mast base and center fin, an underwater lighting system, or an underwater viewing apparatus.

A critical element of this invention is related to the location of the hollow protrusion 102 in the stand up paddle board 101 and the equipment associated with the motorized system being located in close proximity to this hollow protrusion 102. For a system to be configured that has all the advantages described in this patent, the position of the hollow protrusion 102 must meet the following criteria. For the purposes of this discussion, the location of the hollow protrusion 102 means the cross sectional center of the hollow area that runs vertically through the board 101 and assumes the hollow protrusion 102 is located on the centerline with respect to port and starboard.

Hollow protrusion 102 may oriented vertically. This means that the axis of the hollow protrusion is in line with the zenith when paddle board 101 is in normal use. This orientation is relative and the vertical orientation may not be exact. However, the general concept of relatively vertical is necessary to ensure that the weight of the motor and propeller assembly 103 below paddle board 101 is in close proximity to hollow protrusion 102.

Hollow protrusion 102 has a round, oval or other geometric cross sectional shape. Round is considered the best shape for the hollow protrusion 102 because a round shaft common to small electric trolling motors will properly fit into the protrusion, and the motor and propeller assembly 103 will be able to rotate allowing the motor to be directionally steered. Other geometric shape may be utilized as well, including those intended to be used to support a non-rotating shaft.

The hollow protrusion 102 is located forward of the rider's operational position on paddle board 101 A rider's normal operating position on a stand up paddle board 101 is close to the board's center of buoyancy. More specifically, a rider's optimal operating position is at a point on the board relative to forward and aft that results in the waterline 501 of the board 101 being relatively parallel with the bottom surface 106 and top surface 107 of the paddle board 101. This is illustrated in FIG. 5 where the hollow protrusion 102 is forward the rider's operating position.

Figure 5:
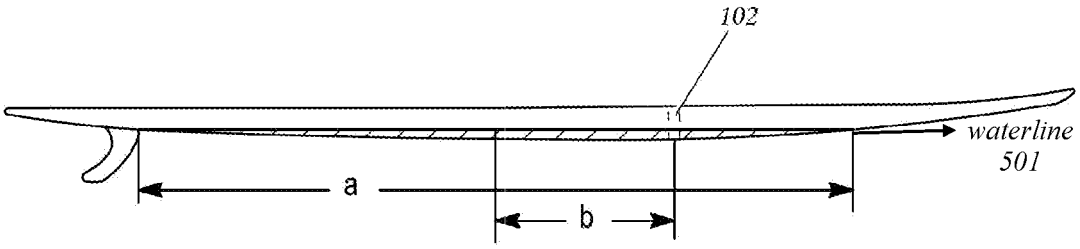
FIG. 5 is a side view diagramming the approximation of the location of the vertical hollow protrusion.

FIG. 5 illustrates a method to determine the location of the hollow protrusion on any type of stand up paddle board or similar stand up personal watercraft based on the board's buoyancy characteristics defined by the waterline and the rider's operating position on the board without the motorized system installed. The proper location for the hollow protrusion (3) is 13% of the length of the waterline 501 ($a \times 0.13 = b$) forward of the rider's position without the motorized system installed (4). And, where the rider's position without the motorized system installed (4) is determined by the location where the section of the board below the waterline is divided into two equal volumes that result in the waterline being relatively parallel with the bottom and top surfaces of the board.

As discussed the optimal position of the hollow protrusion relative to the rider's position may be estimated as thirteen percent (13%) of the waterline 501 but this location may range from 5% to 25% depending on specific design preferences. However, for most applications 13% serves as a good design criteria. This method is derived from empirical testing using motorized systems on a variety of personal watercraft that are intended to be operated in the standing position.

An example of this methodology is presented as follows on a common sized stand up paddle board. A twelve foot (12') long stand up paddle board has a waterline that is eleven feet (132 inches) with an average 160 pound adult standing on the board. Using the 13% rule, the hollow protrusion 102 is to be located seventeen inches (132"× 0.13=17") forward of the rider's position without the motorized system installed. Therefore, installing the hollow protrusion 17 inches forward of the rider's normal operating position on the stand up paddle board without the motorized system is considered the proper location for the hollow protrusion.

This distance may be shorter than 17 inches for various reasons including the need to accommodate a battery and control case 104 that is located forward of the hollow protrusion instead of aft of it. The distance could also be longer than 17 inches to provide more open space on the deck for the rider to operate. The 13% of the waterline method serves as a sound basis for making an initial determination of the location of the hollow protrusion on a particular stand up paddle board or similar personal watercraft.

The 13% rule can also be used to determine the rider's new operating position on paddle board 101 when the battery powered motorized system is installed. Using the example above, the new position is calculated as follows.

$$(132\ \text{in}\times 0.13)+(20\ \text{lb}\times(132\ \text{in}\times 0.13)/160\ \text{lb})=19.3\ \text{inches}$$

Where, the weight of the motorized system is 20 pounds (20 lb) with its mass centered at the location of the hollow protrusion, and Where, the rider's weight is 160 pounds (160 lb), and Where, the length of the waterline is 132 inches.

Using the 13% rule, hollow protrusion 102 will be located nineteen inches (19") forward of the rider's position with a motorized system installed weighting 20 pounds. The first part of the equation equals 17.2 inches (132 in×0.13) and represents the distance between the rider's position without the motorized equipment and the location of hollow protrusion 102. The second part of the equation equals 2.1 inches and represents the distance that the rider is displaced aft from their original position to counterbalance the 20 pounds of motorized equipment installed on the board. In this case the rider must relocate 2.1 inches aft their original position on the board to keep the board balanced in the water so that the waterline remains relatively parallel with top surface 107 and bottom surface 106 of paddle board 101.

Using the 13% rule, the hollow protrusion 102 will be located nineteen inches (19") forward of the rider's position with a motorized system installed weighting 20 pounds. The first part of the equation equals 17.2 inches (132 in×0.13) and represents the distance between the rider's position without the motorized equipment and the location of the hollow protrusion. The second part of the equation equals 2.1 inches and represents the distance that the rider is displaced aft from their original position to counterbalance the 20 pounds of motorized equipment installed on the board. In this case the rider must relocate 2.1 inches aft their original position on the board to keep the board balanced in the water so that the waterline remains relatively parallel with the top surface 107 and bottom surface 106 of paddle board 101

As presented in the example, the 13% rule may be used to calculate both the proper location of the hollow protrusion and the new location of the rider when the motorized system is installed on the board.

In this example, the rider is relocated two inches aft of their normal operating position on board without the motorized system. This relatively small relocation distance is an advantage of this invention because it ensures that the performance of the board including paddling and maneuvering characteristics remain relatively constant with and without the motorized system installed. A distance of 19 inches between the rider and the hollow protrusion provides an adequate area to locate a battery and control assembly and to mechanically secure the motor shaft to the board.

This methodology may be simplified as a practical matter due to the limited range in the lengths of stand up paddle boards that are in common use today. For an adult rider, stand up paddle boards range nominally from 10 feet to 15 feet, nose to tail. Subtracting one foot from the length to account for the length of the board that does not touch the water and is not part of the waterline, results in a waterline range of 9 to 14 feet. Thirteen percent of this waterline length is 14 to 22 inches. For practical purposes the optimal location for the hollow protrusion on any stand up paddle board be from 14 to 22 inches forward of the rider's optimal operating position on the board without the motorized system installed. Empirical data suggests that using this range on a variety of boards instead of 13% of the waterline on a particular board will not result in a significant negative effect on performance. Other considerations may broaden this range further, but for general applications, this range is considered within the normal range for a motorized system with the battery and control assembly located aft of the hollow protrusion.

The Golden Rule may be used as an alternative, or as a supplementary, to the 13% rule described above for determining the proper location of the hollow protrusion on a surf style, stand up paddle board. Surf style boards are characterized as having more rocker, i.e., convex curve across the bottom length of the board, compared to non-surf style boards. In addition, surf style boards have more rounded noses and tails, and more width across on the forward section of the board compared to non-surf style boards.

Figure 6:
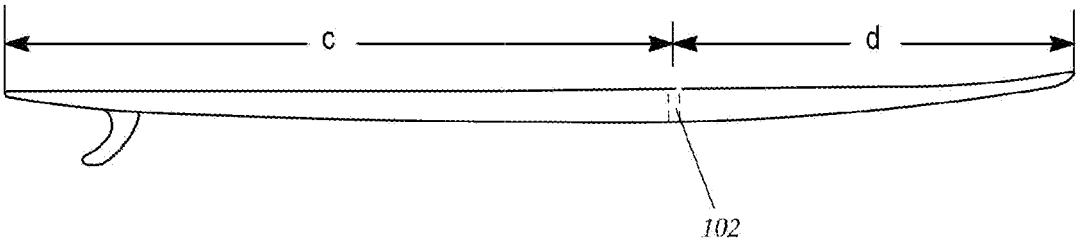
FIG. 6 is a side view diagramming the approximation of the location of the vertical hollow protrusion.

FIG. 6 illustrates a method to determine the location of the hollow protrusion on a surf style stand up paddle board that is determined by applying the Golden Ratio method where; the length from the tail to the hollow protrusion (c) divided by the length from the nose to the hollow protrusion (d) is equal to the entire length of the board (c+d) divided by the length from the tail to the hollow protrusion (c).

The following example shows how the Golden Ratio method is applied in determining the proper location of the hollow protrusion on a twelve foot long (144 inches), surf style, stand up paddle board. In accordance with the standard Golden Ratio equation below, the hollow protrusion is to be placed 89 inches forward of the tail (c=89) and 55 inches aft of the nose (d=55).

$$(c+d)/c=c/d=1.618=\text{Phi}$$

$$(89+55)/89=89/55=1.618=\text{Phi}$$

Once the location of the hollow protrusion is identified using the Gold Ratio, the distance to the rider's optimal operating position without the motorized system install is determined. If that distance is a nominal 17 inches plus or minus 3 inches, the Golden Rule method is considered valid. Similar to the 13% Rule method described above, the location of the hollow protrusion may be adjusted forward or aft depending on the designer's interest.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

The invention claimed is:

1. A method for installing motorized equipment on a stand-up paddle board, the method comprising:

placing a stand-up paddle board in a body of water;

standing on the stand-up paddle board in a balanced position so as to not fall off the stand-up paddle board;

determining end points of a total length of the portion of the stand-up paddle board submerged when stood upon;

determining a positional length by multiplying a predetermined percentage of the total length of the portion of the stand-up paddle board submerged;

determining the midpoint of the end points of said total length of the portion of the stand-up paddle board; and creating a hollow protrusion at a position point forward the midpoint of the end points, the total distance from the midpoint to the position point being equal to the length of the positional length.

2. The method of claim 1, wherein the hollow protrusion is created by drilling.

3. The method of claim 1, further comprising: positioning a motor shaft, the motor shaft extending between the stand-up paddle board.

4. The method of claim 3, further comprising: connecting a motor to the motor shaft, the motor controlling a propeller positioned underneath the stand-up paddle board.

5. The method of claim 4, further comprising: positioning a battery and control assembly on the stand-up paddle board behind the hollow protrusion and forward a rear end, the battery and control assembly comprising a removable waterproof case having an internal battery, an internal electronic electrical control circuit, and a watertight fitting to connect a plurality of electrical connection wires to connect and supply power to the propeller, wherein the user has an unobstructed length between the hollow protrusion and the rear end.

6. The method of claim 5, further comprising: securing the motor support shaft to the stand-up paddle board by a securing device.

7. The method of claim 6, further comprising: securing the motor support shaft to the stand-up paddle board by a securing device, the securing device allowing the motor support shaft to be lifted by the user wherein the motor is retracted from an original position.

8. The method of claim 7, the securing device permitting the propeller to rotate on a vertical axis.

9. The method of claim 7, the securing device securing the motor support shaft in a fixed position.

10. The method of claim 7, wherein the predetermined percentage is 7.

11. A method for installing motorized equipment on a stand-up paddle board: the method comprising:

determining a total length of the stand-up paddle by measuring a length of the stand-up paddle board from a tail end to a nose end of the stand-up paddle board;

determining a general ratio length by dividing the total length of the stand-up paddle board by a number;

determining a ratio point forward the tail end of the stand-up paddle board wherein the length from the tail end to said ratio point is equal to the ratio length; and creating a vertical hollow protrusion at the ratio point.

12. The method of claim 11, wherein the number is 1.618.

13. The method of claim 12, further comprising: positioning a motor shaft, the motor shaft extending between the stand-up paddle board.

14. The method of claim 13, further comprising: connecting a motor to the motor shaft, the motor controlling a propeller positioned underneath the stand-up paddle board.

15. The method of claim 14, further comprising: positioning a battery and control assembly on the stand-up paddle board behind the hollow protrusion and forward a rear end, the battery and control assembly comprising a removable waterproof case having an internal battery, an internal electronic electrical control circuit, and a watertight fitting to connect a plurality of electrical connection wires to connect and supply power to the propeller, wherein the user has an unobstructed length between the hollow protrusion and the rear end.

16. The method of claim 15, further comprising: securing the motor support shaft to the stand-up paddle board by a securing device.

17. The method of claim 16, further comprising: securing the motor support shaft to the stand-up paddle board by a securing device, the securing device allowing the motor support shaft to be lifted by the user wherein the motor is retracted from an original position.

18. The method of claim 17, the securing device permitting the propeller to rotate on a vertical axis.

19. The method of claim 17, the securing device securing the motor support shaft in a fixed position.

20. The method of claim 18, wherein the hollow protrusion is created by drilling.

* * * * *